United States Patent [19]

Wood

[11] Patent Number: 4,634,393

[45] **Date of Patent: * Jan. 6, 1987**

[54] AQUATIC MAT

[75] Inventor: Robert L. Wood, Wichita Falls, Tex.

[73] Assignee: Advanced Sports Corporation, Wichita Falls, Tex.

[ * ] Notice: The portion of the term of this patent subsequent to Feb. 13, 1996 has been disclaimed.

[21] Appl. No.: 704,592

[22] Filed: Feb. 22, 1985

Related U.S. Application Data

[60] Continuation of Ser. No. 270,042, Jun. 3, 1981, abandoned, which is a continuation of Ser. No. 10,102, Feb. 8, 1979, abandoned, which is a continuation-in-part of Ser. No. 743,340, Nov. 19, 1976, Pat. No. 4,138,753, which is a division of Ser. No. 609,049, Aug. 29, 1975, Pat. No. 4,006,503, which is a continuation-in-part of Ser. No. 594,018, Jul. 8, 1975, abandoned.

[51] Int. Cl.[4] ..... B63B 35/72

[52] U.S. Cl. ..... 441/129; 5/481

[58] Field of Search ..... D21/237; 5/417, 419, 5/448, 450, 473, 481; 441/35, 44, 45, 46, 55, 74, 129

[56] References Cited

U.S. PATENT DOCUMENTS

| | | | |
|---|---|---|---|
| D. 224,138 | 7/1972 | Mahler | D6/209 |
| 1,723,473 | 8/1929 | Erickson | 441/74 |
| 2,167,178 | 7/1939 | Kohlstadt | 5/481 X |
| 3,369,262 | 2/1968 | Judd | 5/481 X |
| 3,400,415 | 9/1968 | Scheurer | 441/112 |
| 3,512,190 | 5/1970 | Buff | 5/481 X |
| 3,623,170 | 11/1971 | Staley et al. | 5/463 |
| 3,639,927 | 2/1972 | Munch | 5/481 |
| 4,006,503 | 2/1977 | Wood | 5/353 |
| 4,138,753 | 2/1979 | Wood | 5/353 |
| 4,149,919 | 4/1979 | Lea et al. | 441/129 |
| 4,451,240 | 5/1984 | Wood | 441/129 |

FOREIGN PATENT DOCUMENTS

| | | |
|---|---|---|
| 601681 | 7/1960 | Canada . |
| 1073169 | 1/1960 | Fed. Rep. of Germany . |
| 1145971 | 3/1969 | United Kingdom . |

OTHER PUBLICATIONS

"Get Set for a Safe Boating Season with Ensolite", *U.S. Rubber,* May 1964, p. 47.

*Primary Examiner*—Sherman D. Basinger
*Attorney, Agent, or Firm*—James C. Wray

[57] ABSTRACT

A bouyant, flexible, resilient aquatic mat for use on water surfaces adapted to support one or more persons. The mat comprises an elongated slab and a headrest formed of the same material. The material of the mat comprises a unicellular, non-water absorbent, plastic foam. The material comprising the mat may have a tough plastic coating over the entire surface or by use of a suitable plastic foam material the material comprising the mat may be used without a coating.

15 Claims, 11 Drawing Figures

AQUATIC MAT

This is a continuation of Ser. No. 270,042 filed June 3, 1981, and now abandoned, which is a continuation of Ser. No. 010,102 filed Feb. 8, 1979, and now abandoned, which is a continuation-in-part of Ser. No. 743,340 filed Nov. 19, 1976, now U.S. Pat. No. 4,138,753, which is a division of Ser. No. 609,049 filed Aug. 29, 1975, now U.S. Pat. No. 4,006,503, which is a continuation-in-part of Ser. No. 594,018 filed July 8, 1975, now abandoned.

BACKGROUND OF THE INVENTION

This invention related to an aquatic floatation mat or cushion providing sufficient buoyancy to permit a person to lie on the mat in water.

Aquatic mats now used for recreation and sports purposes are generally of the inflatable type. Although the inflatable types are satisfactory, they require the task of inflating them prior to use and deflating them after use. Furthermore, inflatable types can easily be punctured, ripped or torn. This will require patching, and if the tear or rip is large enough and cannot be patched, will render the mat useless.

The floatation mat of the present invention constitutes an improvement over inflatable mats by eliminating the requirement for inflation and also eliminating the problem of punctures, rips and tears.

SUMMARY OF THE INVENTION

It is an object of this invention to provide a novel aquatic mat with a headrest having a simplified construction, which is capable of floating on water, and which can support one or more persons.

It is another object of this invention to provide a novel aquatic mat having a headrest wherein the entire mat is manufactured from buoyant flexible, resilient slab materials.

Another object of this invention is to provide a novel buoyant, aquatic mat having a headrest for supporting a person's head containing one or more transverse open voids, which provide additional buoyancy to the headrest.

A further object of this invention is to provide a novel buoyant aquatic mat having a headrest containing an enclosed chamber or chambers wherein the bottom of the headrest chamber has vent holes for providing equalization of pressure in the chamber and for providing additional buoyancy to the headrest.

Generally the buoyant aquatic mat comprises an elongated, flexible, resilient, planar slab member and a headrest member containing a transverse void formed from the same material as the planar slab member. The slab material comprises a unicellular, non-water absorbent plastic foam. The material comprising the mat may have a tough plastic coating over the entire surface or by use of a suitable plastic foam material, the material comprising the mat may be used without a coating. Several embodiments of the mat are described. Furthermore, a modification adaptable to all the embodiments of the mat comprises slab material enclosing the ends of the void of the headrest forming an air chamber. An additional modification of the headrest with enclosed chambers is the provision of vent holes disposed through the bottom of the headrest communicating with the air chamber.

Other features and advantages of the various embodiments of the aquatic mat of the invention will become apparent from the following description of specific embodiments thereof taken in conjunction with the drawings.

DETAILED DESCRIPTION OF THE INVENTION

Figure 1:
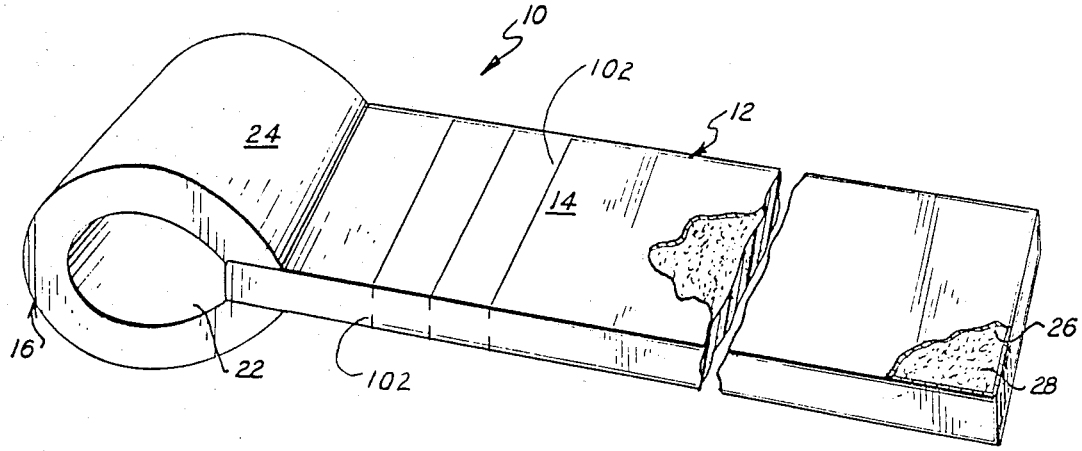
FIG. 1 is a perspective view of one embodiment of the aquatic mat of this invention.
Figure 2:
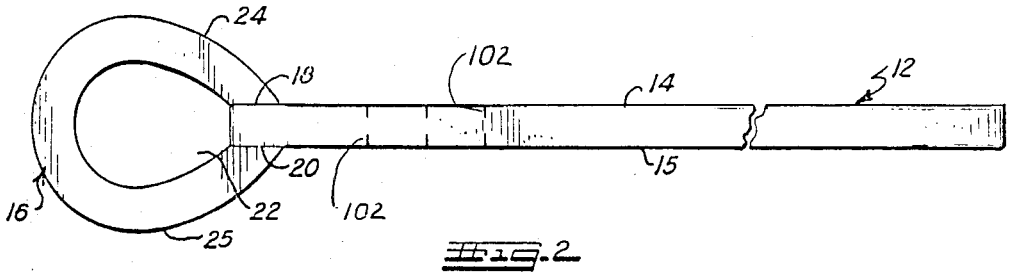
FIG. 2 is a side elevational view of the aquatic mat shown in FIG. 1.
Figure 3:
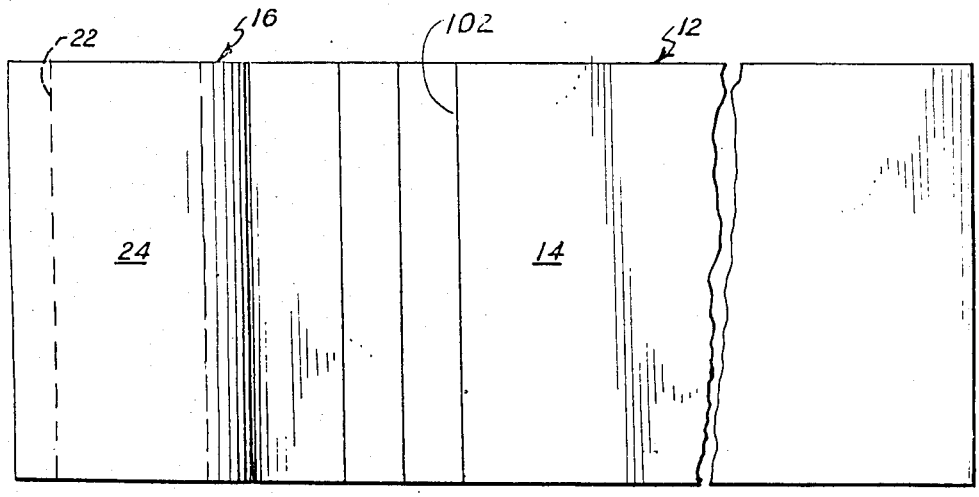
FIG. 3 is a top plan view of the aquatic mat shown in FIG. 1.
Figure 4:
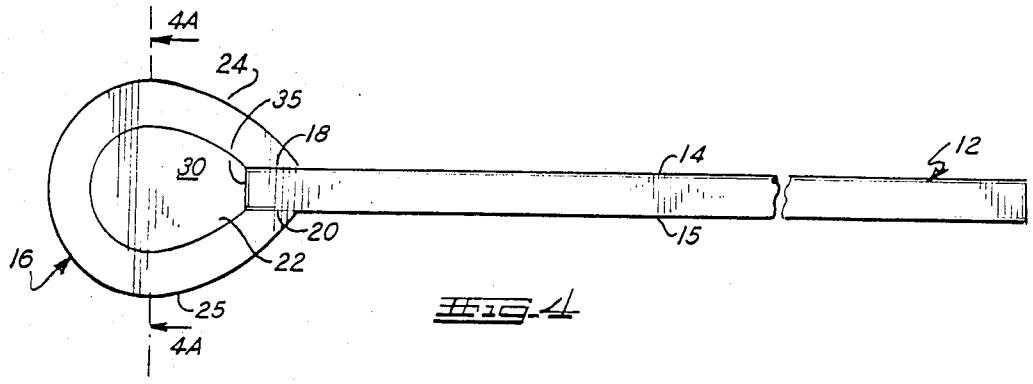
FIG. 4 is a side elevational view of a modification of the aquatic mat embodiment shown in FIG. 1.
Figure 4A:
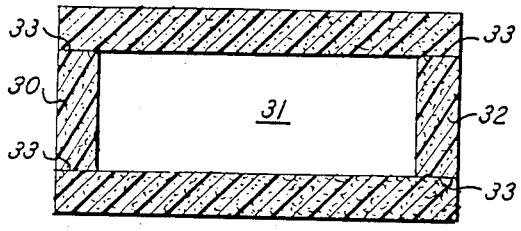
FIG. 4A is a section taken along line 4A—4A of FIG. 4.
Figure 5:
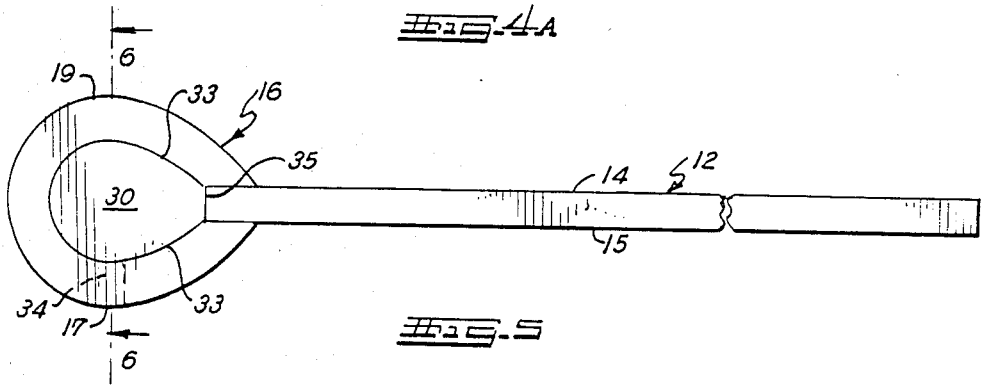
FIG. 5 is a side elevational view of a further modification of the aquatic mat embodiment shown in FIG. 4.
Figure 6:
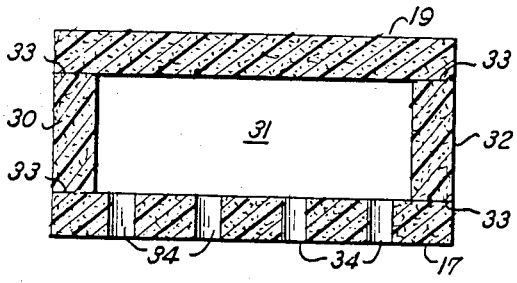
FIG. 6 is a section taken along line 6—6 of FIG. 5.
Figure 7:
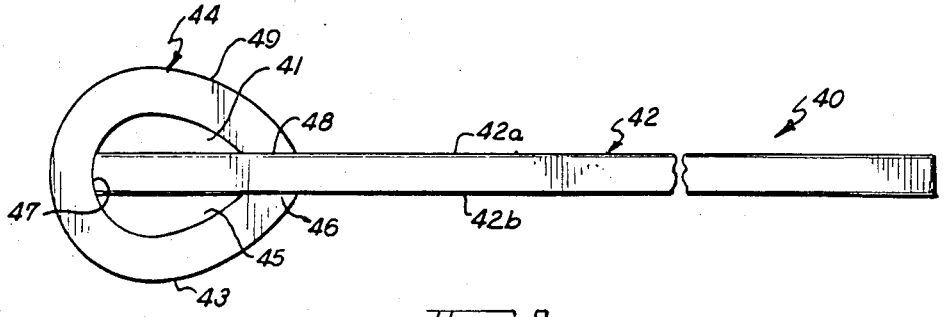
FIG. 7 is a side elevational view of a second embodiment of the aquatic mat of this invention.
Figure 8:
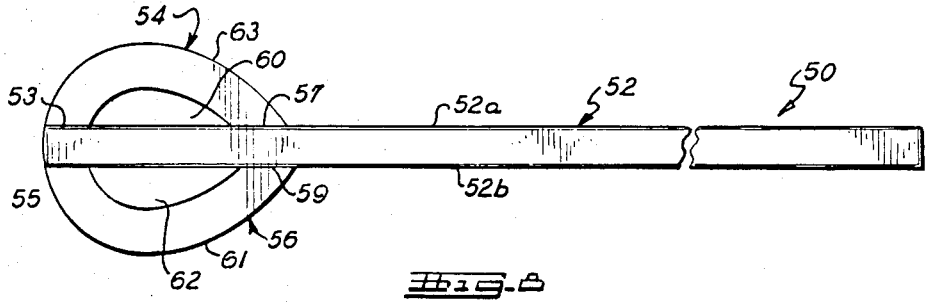
FIG. 8 is a side elevational view of a third embodiment of the aquatic mat of this invention.
Figure 9:
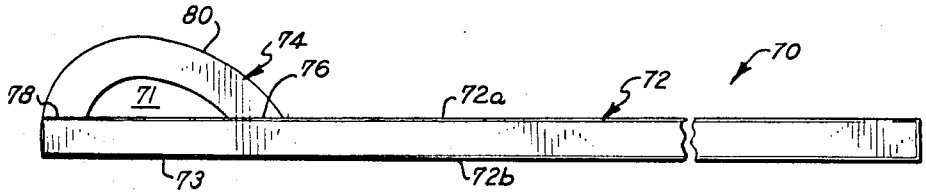
FIG. 9 is a side elevational view of a fourth embodiment of the aquatic mat of this invention.
Figure 10:
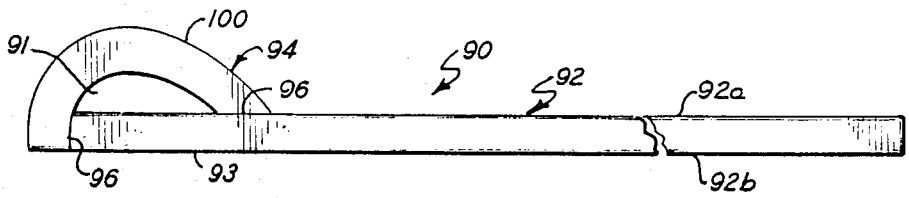
FIG. 10 is a side elevational view of a fifth embodiment of the aquatic mat of this invention.

Referring to FIGS. 1-3 of the drawings, the numeral 10 in FIG. 1 generally denotes a first embodiment of the aquatic mat of the invention. The mat 10 comprises an elongated slab generally denoted by the numeral 12, having planar surfaces 14 and 15, a generally rectangular shape, and a suitable thickness of one to three inches or more. Although a rectangular shape is shown, it is contemplated within the scope of the invention that other geometric shapes can be used such as circular, ovate, polygonal, etc. The slab is of a sufficient surface area, i.e., length and width, to accommodate a person or persons lying prostrate on one of its surfaces 14 or 15.

The slab is constructed or molded from a suitable, flexible, resilient material 28, which is non-water absorbent, such as plastic foam or the like. Particularly, the plastic foam is a unicellular, flexible, plastic foam, i.e., a foam having closed cells, such as plastic foams produced from polyvinylchloride, and the like. The plastic foam material is relatively firm, but at the same time has buoyancy in water, resiliency and flexibility for supporting a person. An example of a suitable plastic foam material, although numerous unicellular plastic foams are suitable, is that produced by Uniroyal under the tradename "ENSOLITE". "ENSOLITE" is a patented blend of nitrite rubber and PVC and can be used without any surface treatment, such as coating, or may preferably be coated to provide decorative properties. Such surface coating or casing 26, preferably smooth, covers the entire resilient material throughout all its surfaces and is a tough, pliable, tear resistant material of a suitable plastic material, or the like. The coating is preferably applied on the surfaces of the resilient material by spraying, dipping or by any other suitable means, whereby the coating adheres tenaciously to the surfaces. Plastic materials are preferred for the coating, since there are available on the market many tough, rugged, pliable plastic coating materials such as polyvinylchloride etc. Hereinafter, all the materials used in the const
scribe
Ma
denot
mater
of wh
In the
foam
slab 1
of sla
be co
ing th
The
face
struct
coatin
Th
faces
Thus,
or 15
both
the h
a surf
of on
In
the ac
erally
from
and b
of the
show
the in
the er
ber 3
show
bers b
leadp
transv
additi
Re
furthe
cham
mat 1
surfac
portic
34, u
acros
munic
equal
ambic
chang
struct
the h
air as
of the
19 fr
that i
cham
mat 1
secon
videc
an en
enclo
the fu
with
modi
the n 40, 50, 70 and 90. In each of these embodiments as modified with airtight chambers, a series of vent holes can be provided along the bottom of the headrest. Thus, in embodiment 40, the series of vent holes are disposed through headrest surface 43; and in embodiment 50, the vent holes are disposed through headrest surface 61. In embodiments 70 and 90, the vent holes are disposed through portion 73 of slab 72 and through portion 91 of slab 92, respectively. When the vent holes are provided, all the mat embodiments are used with the surface containing the vent holes on the surface of water.

From the above description of the aquatic floatable, mat of the invention, it is clear that a novel mat is provided for use in water sports, leisure, etc. The optional coating or casing 26 provides a surface which is smooth and protects the plastic foam 28 within. However, even if the coating 26 is damaged, ripped or torn, etc., the buoyancy of the mat is not diminished, because of the use of non-water absorbent closed-cell type plastic foam. Although the mat has particular adaptability for use on water surfaces, it is understood that the mat can also be used on solid surfaces and also on uneven surfaces, such as sand beaches, to which the bottom of the mat will conform.

From the foregoing description, one skilled in the art can easily ascertain the essential characteristics of this invention, and without departing from the spirit and scope thereof, can make various changes and modifications of the invention to adapt it to various usages and conditions.

I claim:

1. An aquatic flotation mat capable of floating in water and supporting one or more persons, comprising an elongated planar member having top and bottom planar surfaces and a headrest secured to and extending from an end portion of said planar member; said planar member and said headrest formed from closed cell, plastic foam slab members, which are flexible, resilient and non-water absorbent; said headrest slab member having ends thereof secured to an end portion of said planar member, and includes one open transverse void above said top planar surface; said elongated planar member having transverse creases formed in upper and lower surfaces of the elongated planar member; said creases extending equidistantly into the elongated planar member, said creases being placed so that the creases on each respective planar surface oppose creases on the opposing respective planar surface, and said creases being spaced so as to enable the aquatic mat to be easily rolled up.

2. The aquatic mat of claim 1, wherein the headrest is curved around an end portion of said planar member, the ends of said headrest are secured to the top and bottom planar surfaces at an intermediate portion near the said end portion of said planar member, and the end edge of said planar member is secured to an inner surface of said curved headrest slab member thereby forming two transverse voids, wherein one void is above said top planar surface and one void is below said bottom planar surface of said planar member.

3. The aquatic mat of claim 1, wherein the plastic foam material has a surface coating of a tough pliable, plastic material.

4. The aquatic mat of claim 3, wherein said plastic coating material is firmly adherent to said plastic foam.

5. The aquatic mat of claim 3, wherein said plastic coating is a sprayed coating.

6. The aquatic mat of claim 3, wherein said plastic coating is a dipped coating.

7. The aquatic mat of claim 1, wherein said headrest comprises a curved slab member on each said top and bottom planar surface at said end portion of said planar member, one end of each said respective slab member secured to the said end portion of said respective planar surface and the other end of each said respective slab member secured to an intermediate portion of said respective planar surface near said end portion thereby forming two transverse voids, wherein one void is above and one void is below said planar member.

8. The aquatic mat of claim 1, wherein said headrest comprises one curved slab member on said top planar surface of said planar member, one end of said slab member secured to the end portion of said top planar surface and the other end secured to an intermediate portion of said top planar surface near said end portion thereby forming one transverse void above said top planar surface.

9. The aquatic mat of claim 8, wherein said headrest comprises end members enclosing said transverse void to form an air chamber, and vent holes disposed through said headrest communicating with said air chamber.

10. The aquatic mat of claim 1, wherein said headrest comprises one curved slab member on said top planar surface of said planar member, one end of said slab member secured to the end edge of said planar member and the other end secured to an intermediate portion of said top planar surface near said end portion thereby forming one transverse void above said top planar surface.

11. The aquatic mat of claim 1, wherein said plastic foam is produced from polyvinylchloride.

12. The aquatic mat of claim 1, wherein said headrest comprises end members enclosing said transverse void to form an air chamber.

13. The aquatic mat of claim 12, wherein said headrest has an enclosed transverse void disposed below the bottom planar surface comprising vent holes in the bottom portion of said headrest communicating with said air chamber.

14. The aquatic mat of claim 1, wherein said transverse creases are provided by placing creases on one planar surface of said elongated planar member.

15. The aquatic mat of claim 14, wherein one crease is provided equidistant from the ends of the elongated planar member.

* * * * *